US010074474B2

(12) United States Patent
Harrison

(10) Patent No.: US 10,074,474 B2
(45) Date of Patent: Sep. 11, 2018

(54) MATRIX PLANAR TRANSFORMER

(71) Applicant: Enphase Energy, Inc., Petaluma, CA (US)

(72) Inventor: Michael J. Harrison, Petaluma, CA (US)

(73) Assignee: Enphase Energy, Inc., Petaluma, CA (US)

( * ) Notice: Subject to any disclaimer, the term of this patent is extended or adjusted under 35 U.S.C. 154(b) by 2 days.

(21) Appl. No.: 15/593,793

(22) Filed: May 12, 2017

(65) Prior Publication Data

US 2017/0330678 A1 Nov. 16, 2017

Related U.S. Application Data

(60) Provisional application No. 62/336,125, filed on May 13, 2016.

(51) Int. Cl.
*H01F 27/28* (2006.01)
*H01F 3/10* (2006.01)

(52) U.S. Cl.
CPC ..... *H01F 27/2804* (2013.01); *H01F 3/10* (2013.01); *H01F 2027/2809* (2013.01); *H01F 2027/2819* (2013.01)

(58) Field of Classification Search
CPC ..... H01F 27/24; H01F 27/2804; H01F 38/42; H01F 2027/2819; H01F 19/00; H01F 2027/2809; H02M 7/44
See application file for complete search history.

(56) References Cited

U.S. PATENT DOCUMENTS 4,665,357 A * 5/1987 Herbert ..... H01F 19/00 323/345
8,466,765 B2 * 6/2013 Markowski ..... H01F 27/2804 336/170
2004/0145445 A1 * 7/2004 Yang ..... H01F 27/2804 336/223

(Continued)

OTHER PUBLICATIONS

D. Huang, S. Ji and F. C. Lee, "LLC Resonant Converter With Matrix Transformer," in IEEE Transactions on Power Electronics, vol. 29, No. 8, pp. 4339-4347, Aug. 2014.*

(Continued)

*Primary Examiner* — Nguyen Tran
*Assistant Examiner* — Jye-June Lee
(74) *Attorney, Agent, or Firm* — Moser Taboada

(57) ABSTRACT

A planar matrix transformer assembly. In one embodiment, the assembly comprises (a) a core comprising multiple center posts in a matrix pattern; and multiple edge posts along edges of the core for a magnetic flux return path; (b) a single-turn layer comprising a top winding on the top the layer to form a single turn around each center post; and a bottom winding electrically coupled to the top winding and on the bottom of the layer to form a single turn around each center post; and (c) a multi-turn layer comprising multiple top-side windings on top of the layer, wherein each top-side winding is a multi-turn winding around a different center post; and multiple bottom-side windings on the bottom of the multi-turn layer, wherein each bottom-side winding is (i) electrically coupled to a different top-side winding in a one-to-one correspondence, and (ii) a multi-turn winding around a different center post.

20 Claims, 11 Drawing Sheets

(56) References Cited

U.S. PATENT DOCUMENTS

2013/0057164 A1* 3/2013 Gruber ..... H01F 27/2804
315/185 R
2014/0300442 A1* 10/2014 Barthold ..... H01F 27/2804
336/200

OTHER PUBLICATIONS

"Planar E Cores", Philips Magnetic Products.
"Planar Transformer Prototyping Kit", Designer's Kit C356, Coilcraft.
Ngo et al., "Modeling of Magnetizing Inductance and Leakage Inductance in a Matrix Transformer", IEEE Transactions on Power Electronics, vol. 8, Issue 2, pp. 200-207, Apr. 1993.
Ngo et al., "Modeling of Losses in a Sandwiched-Winding Matrix Transformer", IEEE Transactions on Power Electronics, vol. 10, Issue 4, pp. 427-434, Jul. 1995.
Huang et al., "Matrix Transformer for LLC Resonant Converter", IEEE Twenty-Eighth Annual Applied Power Electronics Conference and Exposition (APEC), pp. 1-40, 2013.
Fei et al., "High-Efficiency High-Power-Density 380V/12V DC/DC Converter With a Novel Matrix Transformer", IEEE Applied Power Electronics Conference and Exposition (APEC), pp. 2428-2435, 2017.

* cited by examiner

MATRIX PLANAR TRANSFORMER

CROSS-REFERENCE TO RELATED APPLICATIONS

This application claims benefit of U.S. provisional patent application Ser. No. 62/336,125, titled "Matrix Planar Transformer" and filed May 13, 2016, which is herein incorporated in its entirety by reference.

BACKGROUND OF THE INVENTION

Field of the Invention

Embodiments of the present disclosure relate generally to transformers and, more particularly, to a matrix planar transformer.

Description of the Related Art

Planar transformers are well-known in the art and provide advantages over traditional wire-wound transformers such as high power density at a lower volume and weight. However, such transformers also have several disadvantages. Traditional wire-wound transformers are typically designed to use multiple turn windings for both the primary and secondary windings in order to allow the core size to be reduced. Multiple windings are challenging for planar transformers as they require the need to use an expensive "buried via" printed circuit board (PCB) process or to stack up multiple separate PCBs that then need to be physically interconnected.

Additionally, the physical construction of planar transformers is complex and expensive, and conventional planar transformer designs are challenged based on meeting flux density design constraints. To ease the design constraints, ideally one of the windings is limited to a single turn, which typically requires the use of a very large core and thereby increases the transformer's cost and core loss.

Therefore, there is a need in the art for an improved planar transformer.

SUMMARY OF THE INVENTION

Embodiments of the present invention generally relate to a matrix planar transformer assembly substantially as shown and/or described in connection with at least one of the figures, as set forth more completely in the claims.

Various advantages, aspects and novel features of the present disclosure, as well as details of an illustrated embodiment thereof, will be more fully understood from the following description and drawings.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention generally relate to a matrix planar transformer assembly having a single core which comprises two core halves. In one or more embodiments, each core half comprises a matrix of round center posts arranged in a grid formation along with a plurality of corner posts (which also may be referred to as edge posts) disposed along the edges of the core halves to provide a magnetic flux return path. The transformer assembly further comprises a single-turn printed circuit board (PCB) having a single-turn PCB copper trace pattern (although other conductive material may be used) on each of the top and bottom sides of the board, and a multi-turn PCB having a plurality of multi-turn PCB copper traces (although other conductive material may be used) on each of the top and bottom sides of the board. The transformer assembly described herein allows for a multiple turn design to be constructed using just two PCB copper layers per winding and allows for considerable core volume reduction compared to conventional planar transformer designs.

The core design described herein enables a number of desirable features, including minimizing inter-winding leakage through total interleaving, minimizing winding proximity effects, providing a low-profile transformer design (which is desirable from a thermal design perspective), balancing the mean track length based meandering winding design, and also benefits from a winding multiplying effect; for example, a 2×2 matrix design with four center posts provides the same flux density as a five-turn transformer. This concept is extendable to a design having a higher number of posts—e.g. a 4×4 matrix design with sixteen center posts has the same effective flux density as a twenty-two turn design.

In certain embodiments, the single-turn PCB windings may be split into multiple parallel PCB copper traces for mitigating negative effects due to the skin effect. In some embodiments, the transformer assembly comprises a flux shunt to separate the single-turn and multi-turn PCBs in order to reduce the magnetic coupling between the windings (e.g., to increase the leakage inductance between the separated windings).

Figure 1:
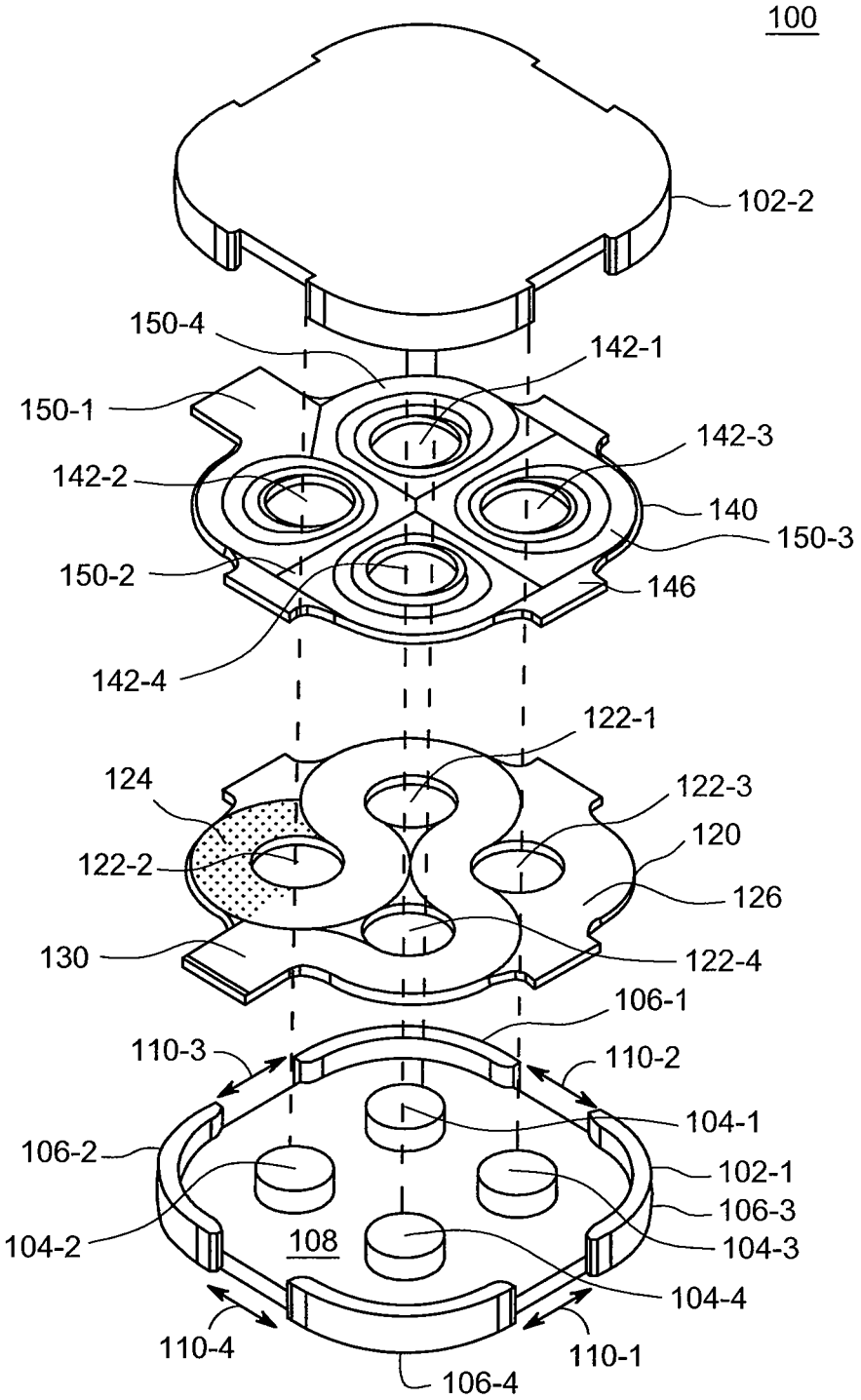
FIG. 1 is an exploded side angled perspective view of a matrix planar transformer assembly in accordance with one or more embodiments of the present invention.

FIG. 1 is an exploded side angled perspective view of a matrix planar transformer assembly 100 in accordance with one or more embodiments of the present invention. The matrix planar transformer assembly 100, which also may be referred to as the transformer assembly 100, comprises a first core half 102-1, a second core half 102-2 (collectively referred to as core halves 102), a single-turn PCB 120 (which may also be referred to as the single-turn layer 120) and a multi-turn PCB 140 (which may also be referred to as the multi-turn layer 140).

In some embodiments, such as the embodiment depicted in FIG. 1, the core halves 102 are identical (or substantially identical) to one another; in other embodiments, one of the core halves 102 may be differently shaped than the other but still mate together to form the transformer assembly 100 described here.

The core half 102-1 is formed from a single piece of magnetic material, such as ferrite, and is substantially shaped as a rounded square plate. The core half 102-1 comprises a plurality of round posts 104-1, 104-2, 104-3, and 104-4 (collectively referred to as posts 104) disposed perpendicular to a backplate 108 in a grid (i.e., matrix) formation. A plurality of corner posts 106-1, 106-2, 106-3, and 106-4 (collectively referred to as corner posts 106) are disposed perpendicular to the backplate 108 along the corners (which also may be referred to as the corner edges or simply edges) of the backplate 108 with one of a plurality of gaps 110-1, 110-2, 110-3, and 110-4 (collectively referred to as gaps 110) between each neighboring corner post 106 as depicted in FIG. 1; for example, corner posts 106-1 and 106-2 are disposed along adjacent corners of the core half 102-1 with the gap 110-3 between them. The corner posts 106 may also be referred to as edge posts 106 or side posts 106 (for example, based on their positioning).

Although four posts 104 and four corner posts 106 are used in the embodiment of FIG. 1, in other embodiments other numbers of posts 104 may be used along with a corresponding number of corner posts 106. For example, for a 2×3 arrangement of six posts 104, the backplate 108 has a substantially rounded rectangular shape with six edge posts 106 disposed along the edges of the backplate 108—four along the backplate corners (i.e., corner posts analogous to those depicted in FIG. 1), and two side posts 106 (one side post 106 on each of the elongated sides of the backplate 108)—with a gap 110 between each neighboring corner post 106. As the number of posts 104 is increased, the diameter and/or surface area of the core half 102 increases; accordingly, the total surface area that determines the flux density is one of the design parameters for designing the matrix planar transformer assembly 100. For example, when the area of a conventional transformer is made bigger, the entire transformer is made bigger in all dimensions in order to return the flux through an appropriate path. In designing the matrix planar transformer assembly 100, a larger number of posts 104 and corner posts 106 (i.e., corner posts, edge posts, and side posts) can be spread out, making the transformer larger but in only two dimensions. For those applications where a height restrictions is required for a transformer and/from a thermal perspective, expanding the transformer 100 in the X and Y dimensions only is very beneficial.

The core half 102-1 mates with the core half 102-2 such that the single and multi-turn PCBs 120 and 140 are "sandwiched" between the core halves 102 and there are no gaps between the mated posts 104/corresponding posts of the core half 102-2 as well as between the mated corner posts 106/corresponding corner posts of the core half 102-2. The single and multi-turn PCBs 120 and 140 are thus substantially enclosed within the mated core halves 102, with the gaps 110 allowing entry/exit for the windings. In some other embodiments where the core halves 102 are not identically shaped, there is no gap between the mated portions of the core halves 102; for example, the core half 102-2 may be a flat plate not having any posts or corner posts and there is no air gap between the corner posts 106 and the corresponding portion of the core half 102-2 to which they are mated, and there is no air gap between the posts 104 and the corresponding portion of the core half 102-2 to which they are mated.

The single-turn PCB 120 comprises a PCB 126 (for example, a conventional FR4 PCB) that defines a plurality of post holes 122-1, 122-2, 122-3, and 122-4 (collectively referred to as post holes 122). The post holes 122 are sized, shaped and positioned such that corresponding posts 104 of the core half 102-1 can pass through the post holes 122. The single-turn PCB 120 further comprises a top winding 130, a bottom winding (not shown), and a plurality of vias 124 as described further below with respect to FIG. 2.

The multi-turn PCB 140 comprises a PCB 146 (for example, a conventional FR4 PCB) that defines a plurality of post holes 142-1, 142-2, 142-3, and 142-4 (collectively referred to as post holes 142). The post holes 142 are sized, shaped, and positioned such that corresponding posts 104 of the core half 102-1 (or posts from the core half 102-2) can pass through the post holes 142. The multi-turn PCB 140 further comprises a plurality of top-side windings 150-1, 150-2, 150-3, and 150-4 (collectively referred to as windings 150), a plurality of bottom-side windings (not shown), and a plurality of groups of vias (not shown) as described further below with respect to FIG. 3.

In some embodiments, the single and multi-turn PCBs 120 and 140 are each self-contained circuit boards as depicted in FIG. 1. In one or more other embodiments, one or both of the single and multi-turn PCBs 120 and 140 may be part of a larger circuit board. In certain embodiments, one of the single and multi-turn PCBs 120 and 140 is part of a main circuit board of a power converter, while the other is an auxiliary circuit board that is mounted on as a separate component. In such embodiments, the power converter may be a DC:DC converter, a DC:AC converter, an AC:DC converter, or an AC:AC converter. In one or more particular embodiments, the transformer assembly 100 is employed in a flyback DC:AC converter. In some alternative embodiments, a substrate other than a PCB may be used for the single-turn layer 120 and/or the multi-turn layer 140.

In one or more alternative embodiments, the single-turn PCB 120 may be replaced by a second multi-turn PCB 140 where one or more of its windings may have a different number of turns from the windings of the first multi-turn PCB 140.

Figure 2:
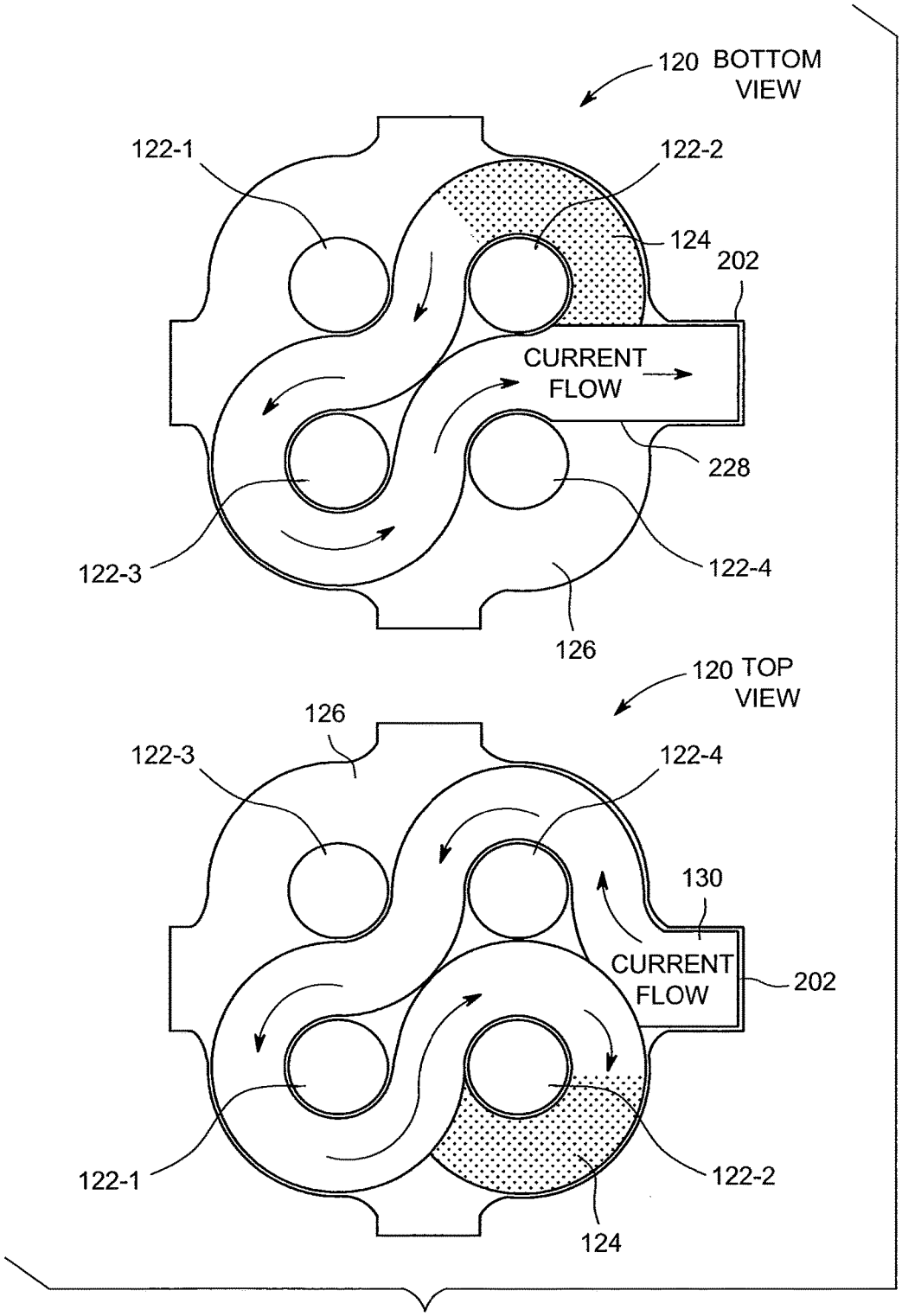
FIG. 2 depicts a top plan view and a bottom plan view of the single-turn PCB in accordance with one or more embodiments of the present invention.

FIG. 2 depicts top and bottom plan views of the single-turn PCB 120 in accordance with one or more embodiments of the present invention.

As shown in the top plan view of FIG. 2, the single-turn PCB 120 comprises the top winding 130 formed from a conductive material (i.e., a single copper trace) disposed on the top side of the PCB 126 in a "figure-eight" type pattern that weaves around the individual posts 104 such that the top winding 130 has only a single turn around each of the posts 104 but creates the effect of a multi-turn winding. As shown in the top plan view of FIG. 2, the current flow enters the top winding 130 at a tab 202 and flows in a substantially figure-eight shaped pattern along the top winding 130 to the plurality of vias 124 at the end of the top winding 130, where the current then flows through the vias 124 to a bottom winding 228 on the bottom side of the PCB 126.

As shown in the bottom plan view of FIG. 2, the bottom winding 228 is a single trace formed from a conductive material (e.g., copper) disposed on the bottom side of the PCB 126 in a "figure-eight" type pattern that weaves around the individual posts 104 such that the bottom winding 228 has only a single turn around each of the posts 104 but creates the effect of a multi-turn winding. The current flow through the bottom winding 228 enters the bottom winding 228 through the plurality of vias 124 and flows in the substantially figure-eight shaped pattern along the bottom winding 228 toward the tab 202, where the current then flows from the bottom winding 228 to a connected element.

Figure 6:
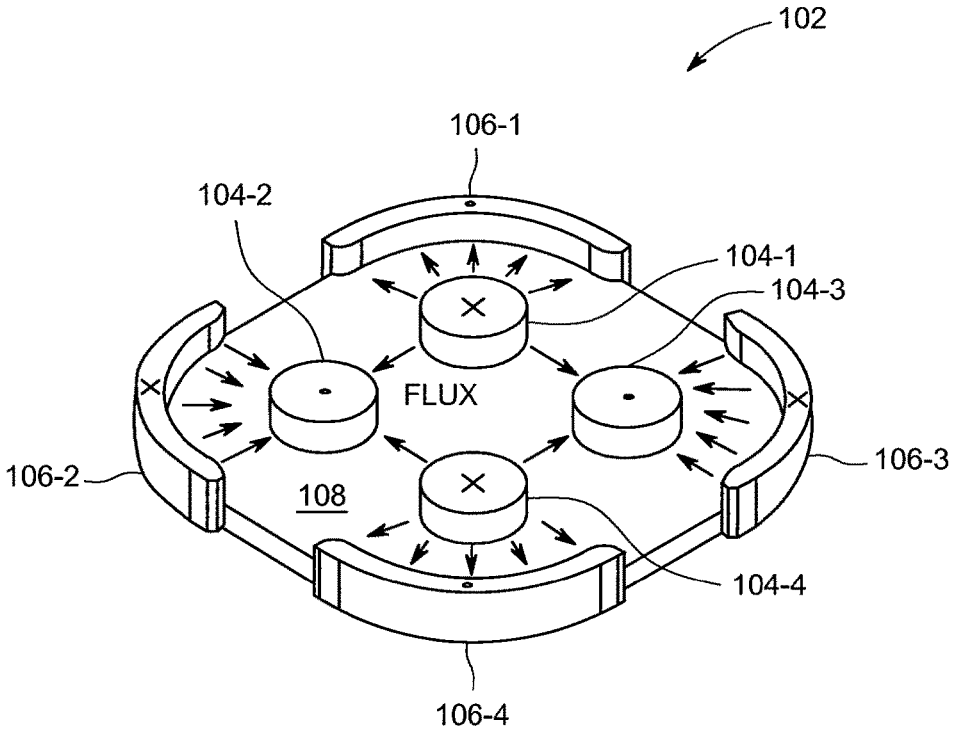
FIG. 6 is a side angled perspective view of a core half in accordance with one or more embodiments of the present invention.

The ratio of the gap between the posts 104 with respect to the diameter of the posts 104 is such that two PCB traces can be accommodated between the diagonal posts 104, thereby allowing the top and bottom windings 130 and 228 to have the single-turn figure-eight winding pattern depicted in FIG. 2. As a result of such a winding pattern, the current flow through the top and bottom windings 130 and 228 and around the core posts 104 generates a "checkerboard" flux pattern through the core posts 104 as shown in FIG. 6 described further below.

The single-turn PCB 120 is generally constructed using a standard PCB photolithography technique as known in the art. Although the windings 130 and 228 are depicted as showing the copper exposed, in other embodiments a solder mask would cover the windings 130 and 228.

Figure 3:
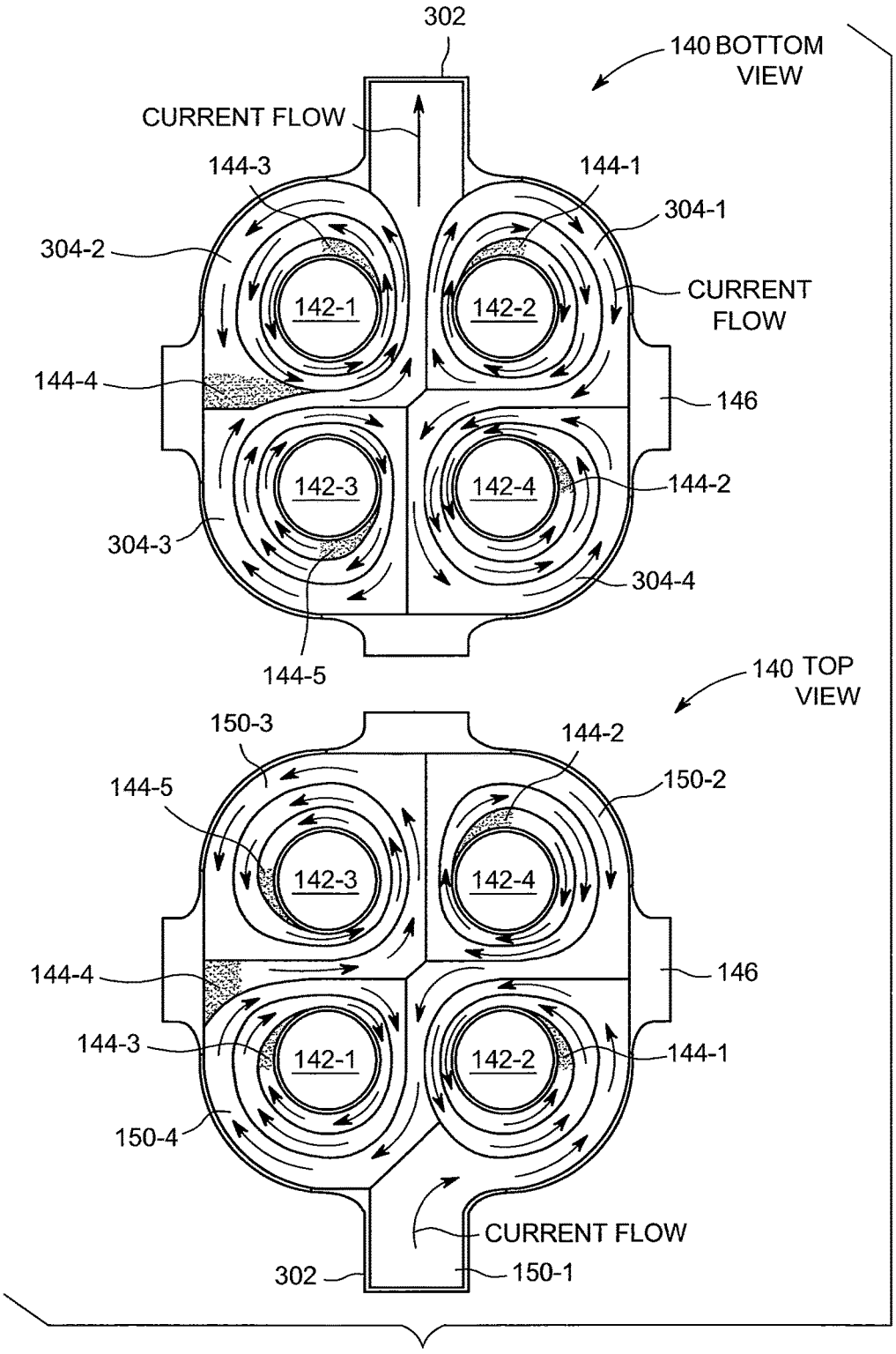
FIG. 3 depicts a top plan view and a bottom plan view of the multi-turn PCB in accordance with one or more embodiments of the present invention.

FIG. 3 depicts top and bottom plan views of the multi-turn PCB 140 in accordance with one or more embodiments of the present invention.

As shown in the top plan view of FIG. 3, the multi-turn PCB 140 comprises a plurality of multi-turn top windings 150-1, 150-2, 150-3, and 150-4 (collectively referred to as top windings 150). Each of the top windings 150 is a single trace formed from a conductive material (e.g., copper) disposed on the top side of the PCB 146 such that, as depicted in FIG. 3, the top winding 150-1 forms a multi-turn winding around the post hole 142-2, the top winding 150-2 forms a multi-turn winding around the post hole 142-4 and becomes the top winding 150-4 which forms a multi-turn winding around the post hole 142-1 (i.e., the top windings 150-2 and 150-4 are formed from the same trace), and the top winding 150-3 forms a multi-turn winding around the post hole 142-3. In addition, a plurality of vias 144-1 is located on the end of the winding 150-1 closest to the post hole 142-2; a plurality of vias 144-2 is located at the end of the winding 150-2 closest to the post hole 142-4; a plurality of vias 144-3 is located at the end of the winding 150-4 closest to the post hole 142-1; and, a plurality of vias 144-4 is located at the end of the winding 150-3 farthest from the post hole 142-3 and a plurality of vias 144-5 is located at the opposite end of the winding 150-3 closest to the post hole 142-3.

As shown in the bottom plan view of FIG. 3, the multi-turn PCB 140 comprises a plurality of multi-turn bottom windings 304-1, 304-2, 304-3 and 304-4 (collectively referred to as bottom windings 304). Each of the bottom windings 304 is a single trace formed from a conductive material (e.g., copper) disposed on the bottom side of the PCB 146 such that, as depicted in FIG. 3, the winding 304-1 forms a multi-turn winding around the post hole 142-2 and becomes the winding 304-4 to form a multi-turn winding around the post hole 142-4 (i.e., the windings 304-1 and 304-4 are formed from the same trace); the winding 304-2 forms a multi-turn winding around the post hole 142-1; and the winding 304-3 forms a multi-turn winding around the post hole 142-3. In addition, the plurality of vias 144-1 is located at the end of the winding 304-1 closest to the post hole 142-2; the plurality of vias 144-2 is located at the end of the winding 304-4 closest to the post hole 142-4; the plurality of vias 144-3 is located at the end of the winding 304-2 closest to the post hole 142-1 and the plurality of vias 144-4 is located at the opposite end of the winding 304-2 furthest from the post hole 142-1; and, the plurality of vias 144-5 is located at the end of the winding 304-3 closest to the post hole 142-3.

Each of the top windings 150 and the bottom windings 304 is wound in a multi-turn, non-overlapping concentric pattern. When current is coupled to the multi-turn PCB 140, the current enters the top winding 150-1 at the top side of the tab 302 of the PCB 146 and flows as shown in FIG. 3 to an output via the bottom winding 304-3 on the bottom side of the tab 302. As a result of the topology of the PCB winding 140, the number of turns around each post 104 can be achieved with relatively few groups of vias which minimizes the number of times the current must flow through the board.

As a result of the multi-turn windings on both the top and the bottom of the multi-turn PCB 140, the current circulates each of the posts 104 five times—two and a half times on the top side of the multi-turn PCB 140 and two and a half times on the bottom side of the multi-turn PCB 140.

The multi-turn PCB 140 is generally constructed using a standard PCB photolithography technique as known in the art. Although the windings 150 and 304 are depicted as showing the copper exposed, in other embodiments a solder mask would cover the windings 150 and 304.

Figure 4:
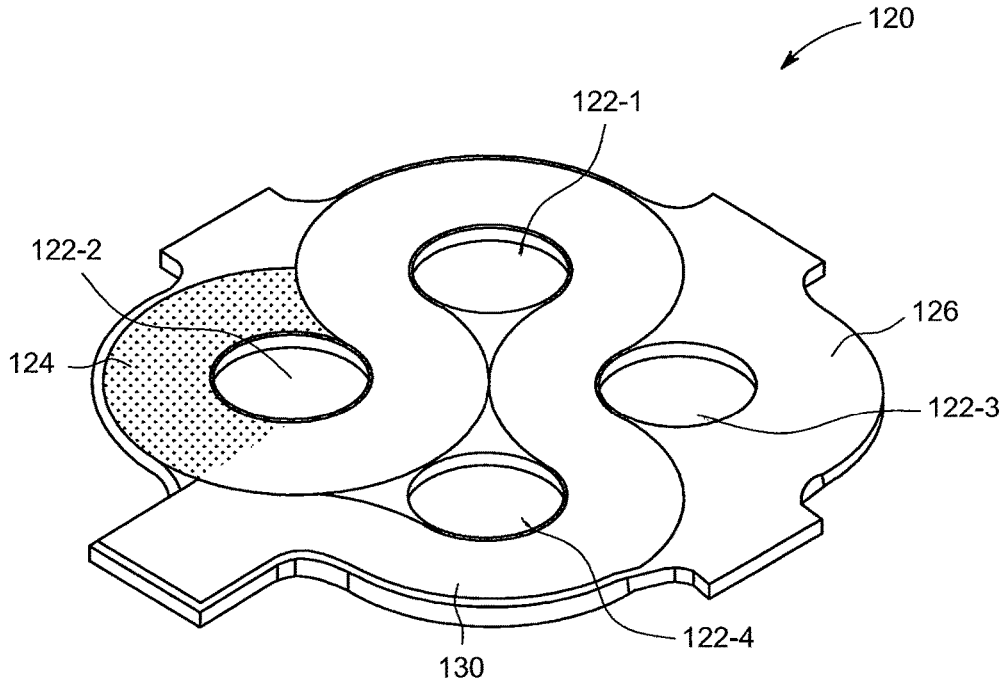
FIG. 4 is a side angled perspective view of a single-turn PCB in accordance with one or more embodiments of the present invention.

FIG. 4 is a side angled perspective view of a single-turn PCB 120 in accordance with one or more embodiments of the present invention. As depicted in FIG. 4, the top side of the single-turn PCB 120 is shown, the top winding 130 disposed on the PCB 126 in a figure-eight type pattern around the post holes 122 and terminating in the plurality of vias 124.

Figure 5:
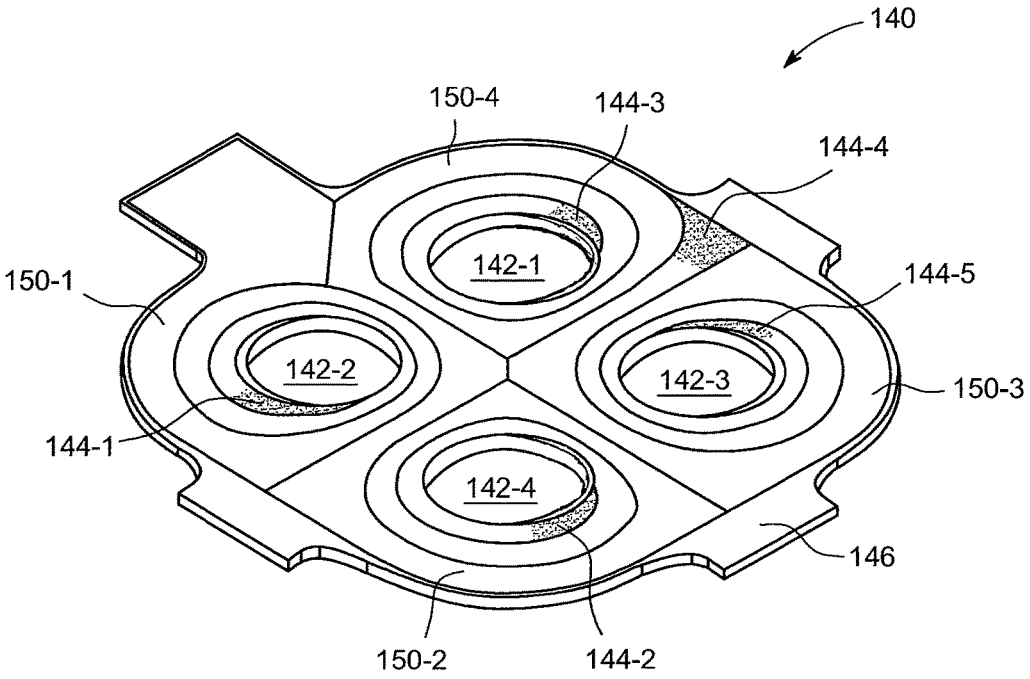
FIG. 5 is a side angled perspective view of a multi-turn PCB in accordance with one or more embodiments of the present invention.

FIG. 5 is a side angled perspective view of a multi-turn PCB 140 in accordance with one or more embodiments of the present invention. As depicted in FIG. 5, the top side of the multi-turn PCB 140 is shown, the top-side windings 150 disposed on the PCB 146. The top-side windings 150-1, 150-2, 150-3, and 150-4 are shown wound around the corresponding post holes 142-2, 142-4, 142-3, and 142-1, respectively, of the PCB 146. The plurality of vias 144-1, 144-2, 144-5 and 144-3 are located at the ends of the top-side windings 150-1, 150-2, 150-3, and 150-4, respectively, that are closes to the corresponding post holes 142-2, 142-4, 142-3, and 142-1. The plurality of vias 144-4 is located at the end of the top-side winding 150-3 farthest from the post hole 142-3.

FIG. 6 is a side angled perspective view of a core half 102 in accordance with one or more embodiments of the present invention. The direction of magnetic flux in the core half 102 resulting from current through the assembled transformer assembly 100 is indicated using a dot and cross notation, as well as arrows. As depicted in FIG. 6, the direction of the magnetic flux with respect to the posts 104 is a "checkerboard" type pattern and the flow of magnetic flux in each corner post 106 is in the opposite direction to that in the nearest post 104. Additionally, the magnetic flux flowing into the posts 104-1 and 104-4 is radiated out from the posts into the backplate 108. By being able to return the flux via multiple different paths (i.e., via posts 104 and corner posts 106) the backplate 108 can be made very thin (e.g., the thickness of the backplate 108 can be made equal to one-quarter of the diameter of the round posts 104), thereby reducing the cost of material, the weight and size of the transformer assembly 100, and core losses for the transformer assembly 100.

Figure 7:
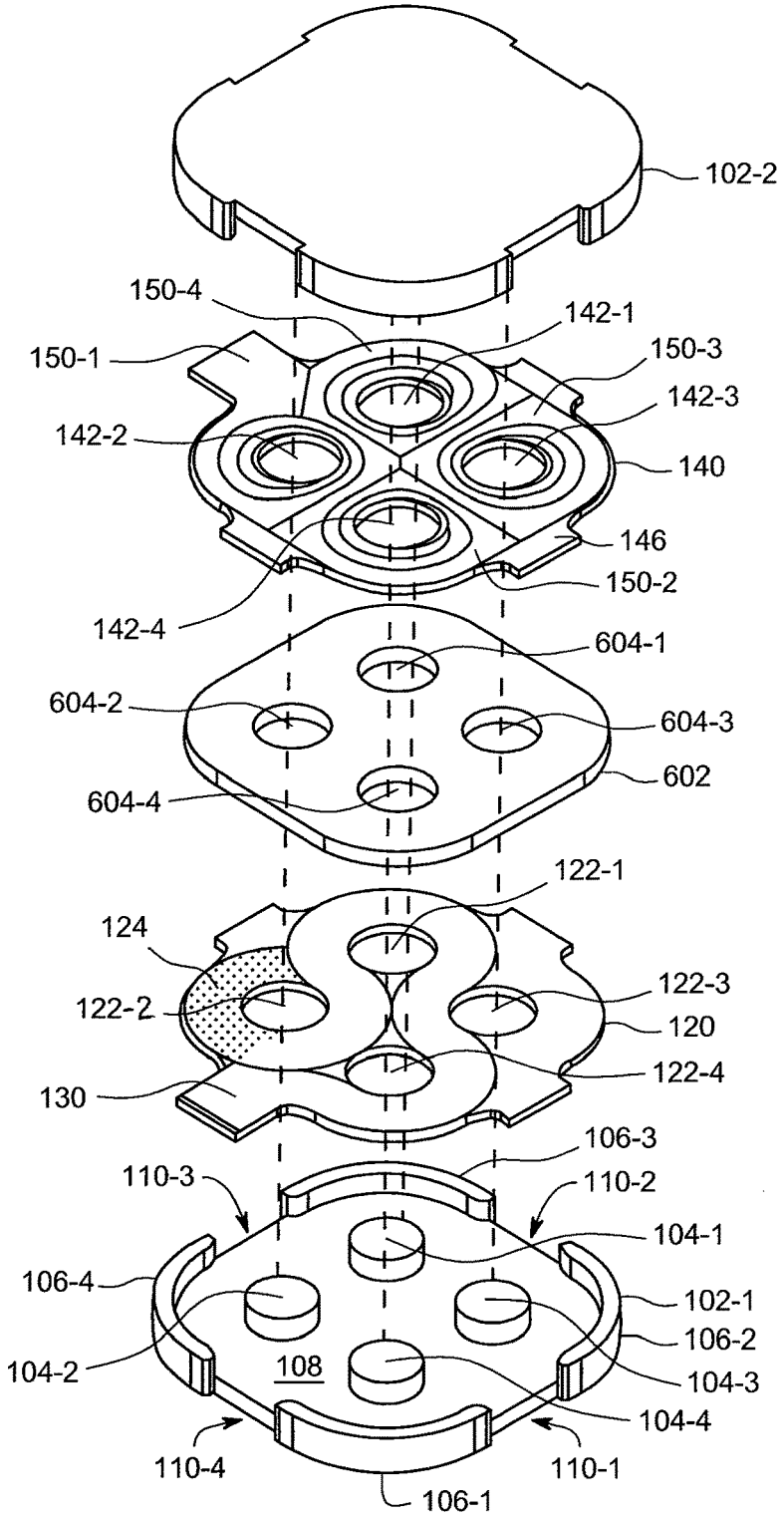
FIG. 7 is an exploded side angled perspective view of a matrix planar transformer assembly in accordance with one or more other embodiments of the present invention.

FIG. 7 is an exploded side angled perspective view of a matrix planar transformer assembly 100 in accordance with one or more other embodiments of the present invention. In addition to the first and second core halves 102-1 and 102-2, the single-turn PCB 120, and the multi-turn PCB 140, as previously described, the transformer assembly 100 depicted in FIG. 7 also comprises a flux shunt 602.

The flux shunt 602 may be formed from the same material as the core halves 102 and defines a plurality of post holes 604-1, 604-2, 604-3, and 604-4 (collectively referred to as post holes 604). The post holes 604 are sized, shaped and positioned such that corresponding posts 104 of the core half 102-1 (and/or any posts of the core half 102-2 as needed) can pass through the post holes 604.

The flux shunt 602 is sandwiched between the single and multi-turn PCBs 120 and 140 to separate the windings in order to reduce their coupling, e.g., to increase the primary-to-secondary winding leakage inductance. Such leakage inductance may be used, for example, in a resonant converter in place of a discreet inductor in a resonant tank of the converter. The efficacy of such a tank "inductor" can be controlled by controlling the gap between the mated core halves 102 and/or the relative permeability of the flux shunt material.

Figure 8:
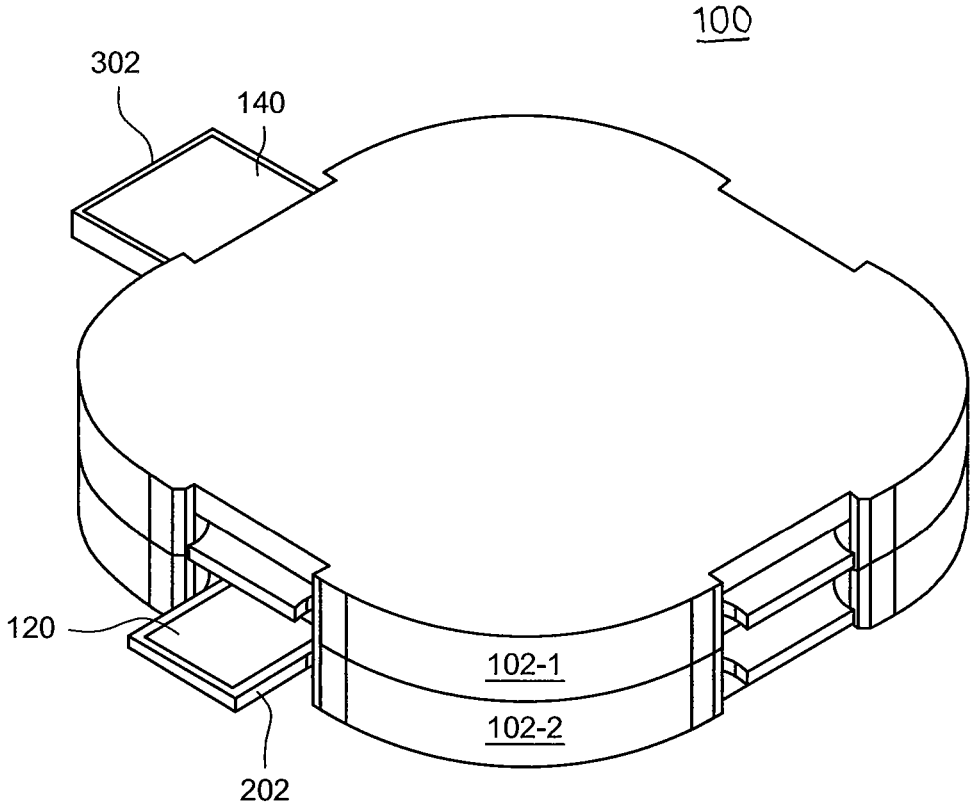
FIG. 8 is a side angled perspective view an assembled transformer assembly in accordance with one or more embodiments of the present invention.

FIG. 8 is a side angled perspective view an assembled transformer assembly 100 in accordance with one or more embodiments of the present invention. As shown in FIG. 8, the tabs 202 and 302 extend from the transformer assembly 100 to allow for connections to be made to the corresponding top and bottom windings.

Figure 9:
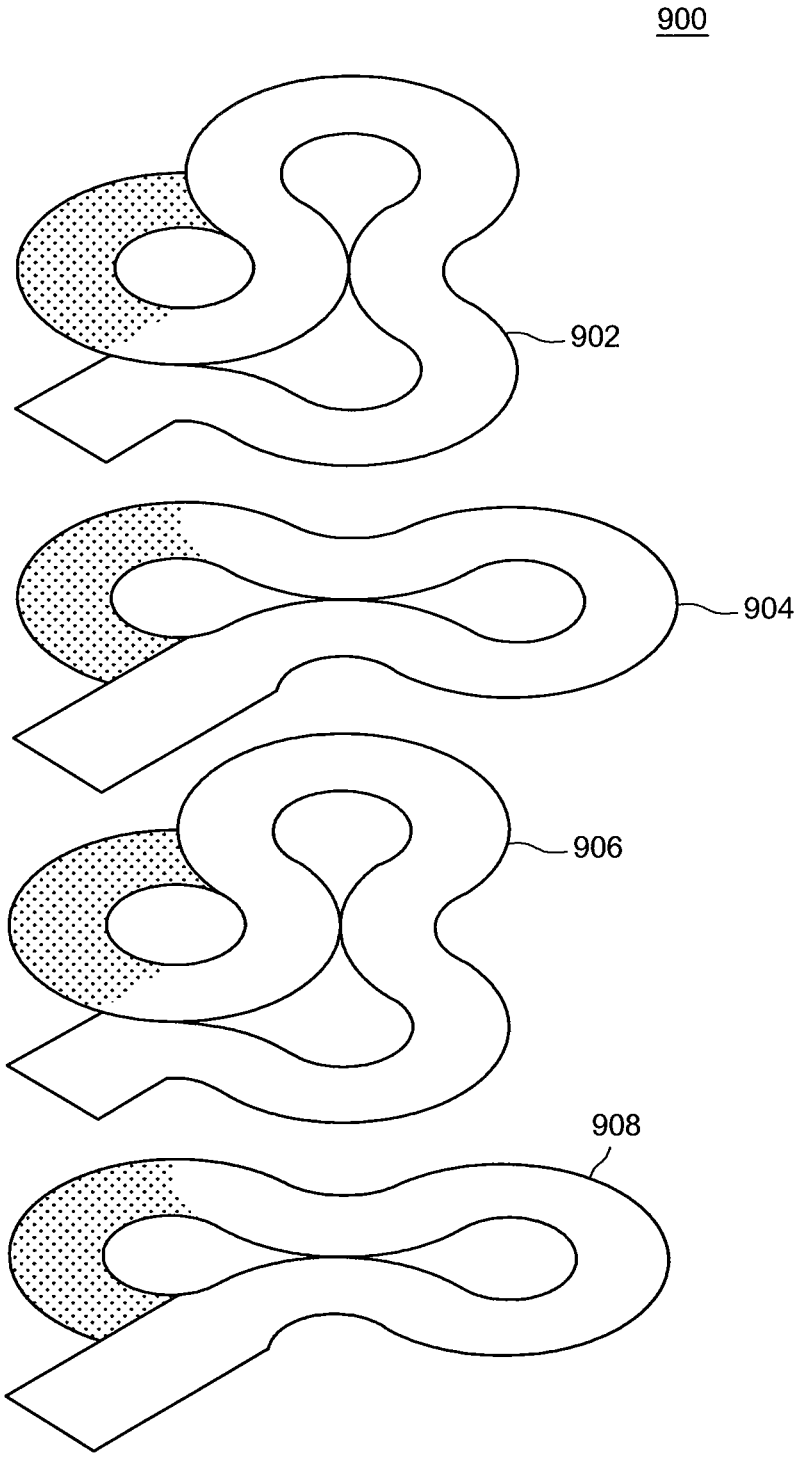
FIG. 9 depicts layers of a four-layer PCB winding in accordance with one or more embodiments of the present invention.

FIG. 9 depicts layers 900 of a four-layer PCB winding in accordance with one or more embodiments of the present invention. The layers 900 are depicted as a first top winding 902, a first bottom winding 904, a second top winding 906, and a second bottom winding 908. The first and second top windings 902 and 906 are analogous to the top winding 130; the first and second bottom windings 904 and 908 are analogous to the bottom winding 228. The first top winding 902 and the first bottom winding 904 form a first winding; the second top winding 906 and the second bottom winding 908 form a second winding. The resulting first and second windings are two independent windings that can be connected externally in parallel or series; alternatively, they can be used as independent windings (e.g., primary and secondary windings). In some other embodiments, the number of layers can be increased further to create a PCB winding having greater than four layers.

Figure 10:
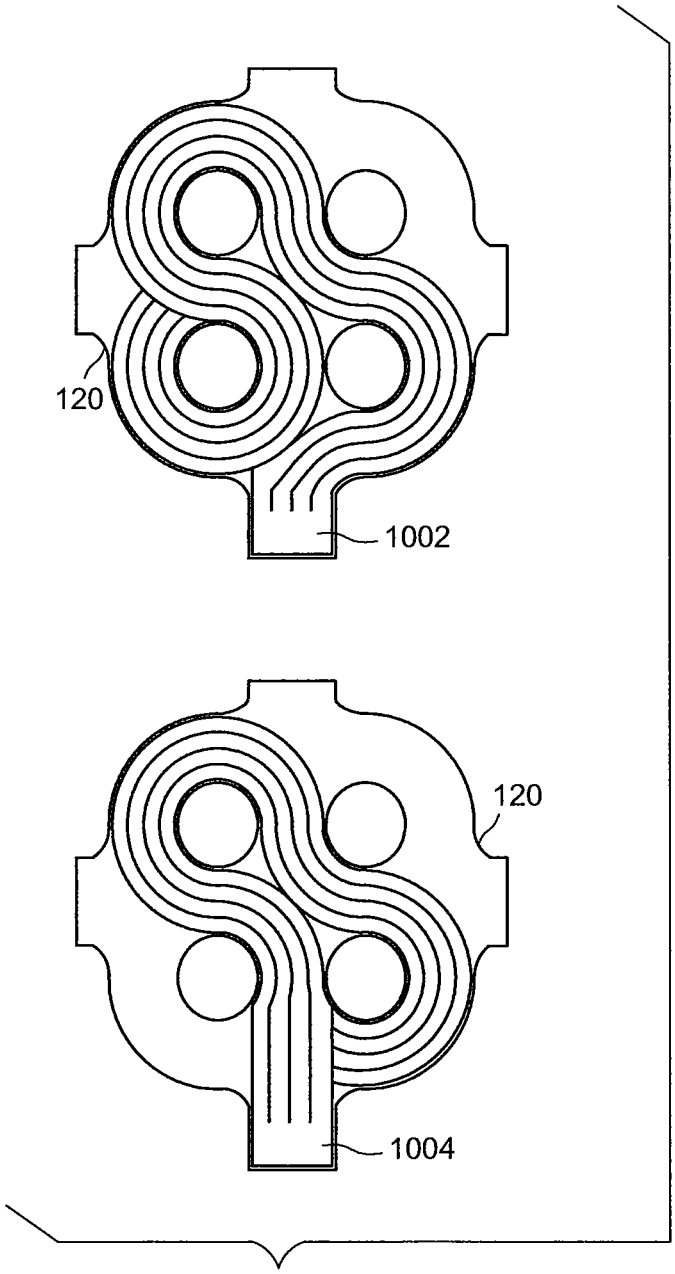
FIG. 10 depicts top and bottom plan views of a single-turn PCB in accordance with one or more other embodiments of the present invention.

FIG. 10 depicts top and bottom plan views of a single-turn PCB 120 in accordance with one or more other embodiments of the present invention. In the embodiment depicted in FIG. 10, top and bottom windings 1002 and 1004 are each split from a single winding to a plurality of narrower parallel windings in order to mitigate high-frequency "current crowding" due to skin effects (thereby achieving similar benefits as those obtained using Litz wire in conventional wound transformers). For the windings 1002 and 1004, the lengths of each parallel path are equal as a result of the figure-eight winding pattern (the corresponding vias are not shown).

Figure 11:
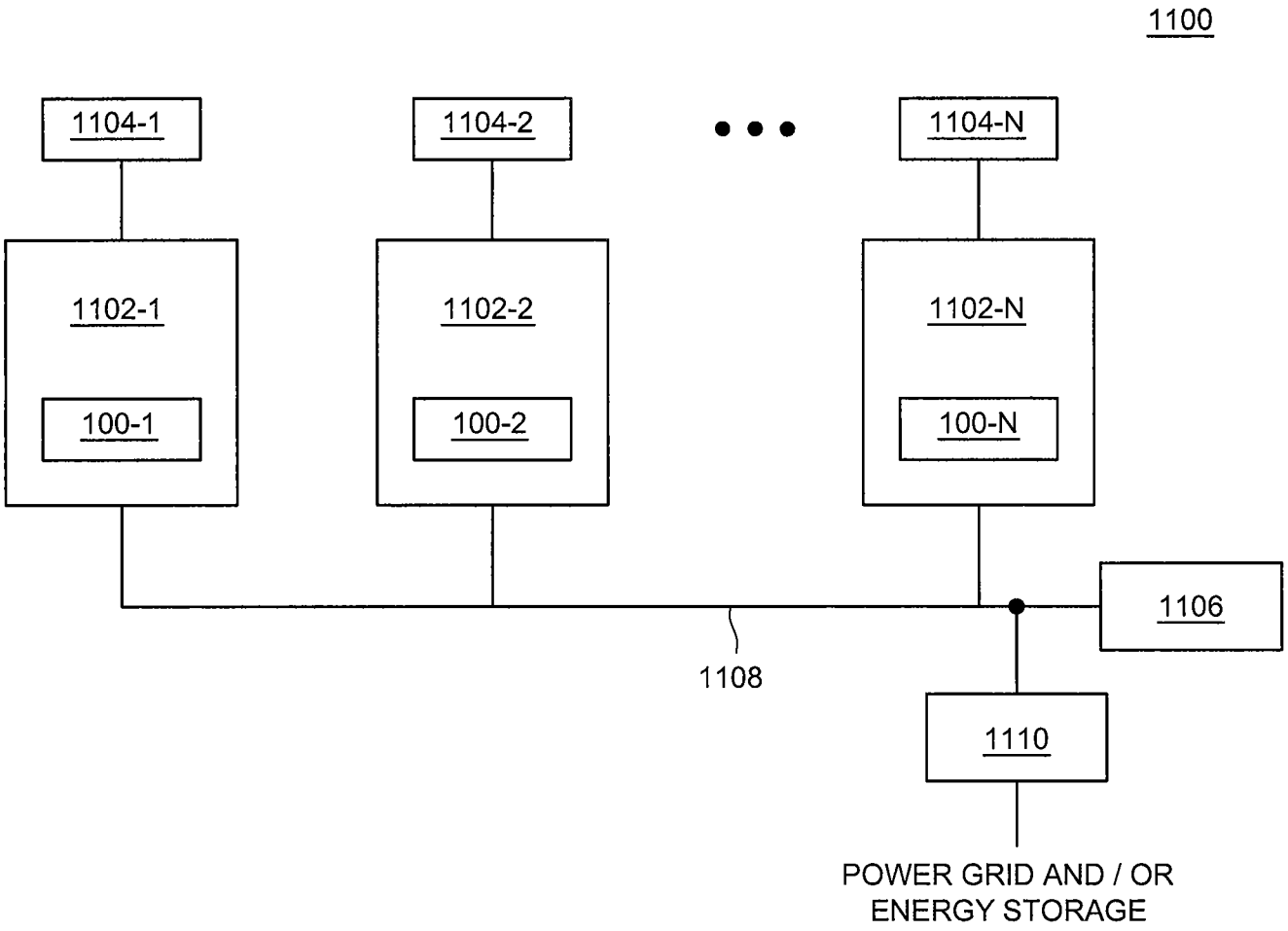
FIG. 11 is a block diagram of a system for power conversion using one or more embodiments of the present invention.

FIG. 11 is a block diagram of a system 1100 for power conversion using one or more embodiments of the present invention. This diagram only portrays one variation of the myriad of possible system configurations and devices that may utilize the present invention. The present invention can be utilized in a variety of systems or devices that employ a transformer, such as certain power converters.

The system 1100 comprises a plurality of power converters 1102-1, 1102-2 . . . 1102-N, collectively referred to as power converters 1102; a plurality of power sources 1104-1, 1104-2 . . . 1104-N, collectively referred to as power sources 1104; a controller 1106; a bus 1108; and a load center 1110. The power sources 1104 may be any suitable DC source, such as an output from a previous power conversion stage, a battery, a renewable energy source (e.g., a solar panel or photovoltaic (PV) module, a wind turbine, a hydroelectric system, or similar renewable energy source), or the like, for providing DC power. In some embodiments, the power converters 1102 may be bidirectional converters and one or more of the power sources 1104 is an energy storage/delivery device that stores energy generated by the corresponding power converter 1102 and couples stored energy to the corresponding power converter 1102.

Each power converter 1102-1, 1102-2 . . . 1102-N is coupled to a power source 1104-1, 1104-2 . . . 1104-N, respectively, in a one-to-one correspondence; in some alternative embodiments, multiple power sources 1104 may be coupled to a single power converter 1102. The power converters 1102 are coupled to the controller 1106 via the bus 1108.

The controller 1106 is capable of communicating with the power converters 1102 by wireless and/or wired communication (e.g., power line communication) for providing operative control of the power converters 1102. In some embodiments, the controller 1106 may be a gateway that receives data (e.g., performance data) from the power converters 1102 and communicates the data and/or other information to a remote device or system, such as a master controller (not shown). Additionally or alternatively, the gateway may receive information from a remote device or system (not shown) and may communicate the information to the power converters 1102 and/or use the information to generate control commands that are issued to the power converters 1102. The power converters 1102 are further coupled to the load center 1110 via the bus 1108.

The power converters 1102 convert the DC power from the DC power sources 1104 to an AC output power and couple the generated output power to the load center 1110 via the bus 1108. The generated power may then be distributed for use, for example to one or more appliances, and/or the generated energy may be stored for later use, for example using batteries, heated water, hydro pumping, $H_2O$-to-hydrogen conversion, or the like. In some embodiments, the power converters 1102 convert the DC input power to AC power that is commercial power grid compliant and couple the AC power to the commercial power grid via the load center 1110. In some other embodiments, the power converters 1102 may be AC:AC converters that receive an AC input; in still other embodiments, the power converters 1102 may be AC:DC or DC:DC converters and the output power is a DC output power and the bus 1108 is a DC bus.

Each of the power converters 1102 comprises a matrix planar transformer assembly 100 (i.e., the power converters 1102-1, 1102-2 . . . 1102-N comprise the matrix planar transformer assemblies 100-1, 100-2 . . . 100-N, respectively) utilized in the conversion of the input power to the output power. In some embodiments, the power converters 1102 are flyback converters and the matrix planar transformer assemblies 100 do not comprise the flux shunt 602. In other embodiments, the power converters 1102 are resonant converters and the matrix planar transformer assemblies 100 each comprise a corresponding flux shunt 602 as previously described.

While the foregoing is directed to embodiments of the present invention, other and further embodiments of the invention may be devised without departing from the basic scope thereof, and the scope thereof is determined by the claims that follow.

The invention claimed is:

1. A planar matrix transformer assembly, comprising:

a magnetic core comprising:

a plurality of center posts arranged in a matrix pattern; and a plurality of edge posts disposed along edges of the magnetic core to provide a magnetic flux return path;

a multi-turn layer comprising:

a plurality of top-side windings disposed on a top side of the multi-turn layer, wherein each top-side winding of the plurality of top-side windings is a multi-turn winding around a different center post of the plurality of center posts; and a plurality of bottom-side windings disposed on a bottom side of the multi-turn layer, wherein each bottom-side winding of the plurality of bottom-side windings is (i) electrically coupled to a different top-side winding of the plurality of top-side windings in a one-to-one correspondence, and (ii) a multi-turn winding around a different center post of the plurality of center posts; and a second layer comprising:

at least one winding disposed on a top side of the second layer, wherein each winding of the at least one winding disposed on the top side of the second layer has at least one turn around at least one center post of the plurality of center posts; and at least one winding disposed on a bottom side of the second layer, wherein each winding of the at least one winding disposed on the bottom side of the second layer (iii) is electrically coupled to a winding of the at least one winding disposed on the top side of the second layer, and (iv) has at least one turn around at least one center post of the plurality of center posts, wherein the multi-turn layer and the second layer are substantially enclosed within the magnetic core.

2. The planar matrix transformer assembly of claim 1, wherein the second layer is a single-turn layer, and wherein the at least one winding disposed on the top side is a top winding disposed on the top side of the single-turn layer to form a single turn around each center post of the plurality of center posts, and wherein the at least one winding disposed on the bottom side of the second layer is a bottom winding electrically coupled to the top winding and disposed on the bottom side of the single-turn layer to form a single turn around each center post of the plurality of center posts.

3. The planar matrix transformer assembly of claim 2, wherein the top winding and the bottom winding are each a single trace of a conductive material.

4. The planar matrix transformer assembly of claim 2, wherein the top winding and the bottom winding are each multiple parallel traces of a conductive material.

5. The planar matrix transformer assembly of claim 2, wherein each of the top-side windings of the plurality of top-side windings and each of the bottom-side windings of the plurality of bottom-side windings is wound in a multi-turn non-overlapping concentric pattern.

6. The planar matrix transformer assembly of claim 2, wherein the bottom winding is electrically coupled to the top winding by a plurality of vias between the top winding and the bottom winding.

7. The planar matrix transformer assembly of claim 2, wherein each bottom-side winding of the plurality of bottom-side windings is electrically coupled to a corresponding top-side winding by a plurality of vias between the bottom-side winding and the corresponding top-side winding.

8. The planar matrix transformer assembly of claim 2, wherein the magnetic core is formed from a first core half and a second core half substantially identical to the first core half, and wherein the first and the second core halves are mated such that the single-turn layer and the multi-turn layers are disposed between the first and the second core halves.

9. The planar matrix transformer assembly of claim 8, wherein the first core half comprises a first portion of the plurality of center posts and the second core half comprises a second portion of the plurality of center posts that mate with the first portion to form the plurality of center posts such that there is no air gap between the first portion and the second portion.

10. The planar matrix transformer assembly of claim 2, further comprising a flux shunt, formed from a magnetic material, disposed between the single-turn layer and the multi-turn layer.

11. The planar matrix transformer assembly of claim 2, wherein the number of center posts in the plurality of center posts is four, and wherein the top winding and the bottom winding are each wound in a figure-eight type pattern around the center posts.

12. The planar matrix transformer assembly of claim 11, wherein the number of edge posts in the plurality of edge posts is four, and wherein each edge post of the plurality of edge posts is disposed at a different corner of the magnetic core.

13. The planar matrix transformer assembly of claim 2, wherein the single-turn layer comprises a first printed circuit board (PCB) upon which the top winding and the bottom winding are disposed, and wherein the multi-turn layer comprises a second PCB upon which the plurality of top-side windings and the plurality of bottom-side windings are disposed.

14. The planar matrix transformer assembly of claim 13, wherein the single-turn layer and the multi-turn layer are each self-contained circuit boards.

15. The planar matrix transformer assembly of claim 13, wherein at least one of the single-turn layer or the multi-turn layer are part of power conversion circuit board of a power converter.

16. The planar matrix transformer assembly of claim 15, wherein the power converter is a DC:AC converter.

17. The planar matrix transformer assembly of claim 16, wherein the DC:AC converter is a flyback converter.

18. The planar matrix transformer assembly of claim 16, wherein the DC:AC converter is a resonant converter.

19. The planar matrix transformer assembly of claim 18, further comprising a flux shunt, formed from a magnetic material, disposed between the single-turn layer and the multi-turn layer.

20. The planar matrix transformer assembly of claim 2, wherein each center post of the plurality of center posts is a round post.

* * * * *